US006036229A

United States Patent [19]

Peleman

[11] Patent Number: 6,036,229

[45] Date of Patent: Mar. 14, 2000

[54] FILE BINDER

[75] Inventor: Guido Peleman, Puurs, Belgium

[73] Assignee: UniBind (Cyprus) Limited, Cyprus

[21] Appl. No.: 09/027,558

[22] Filed: Feb. 23, 1998

[30] Foreign Application Priority Data

Mar. 27, 1997 [BE] Belgium ..... 09700284

[51] Int. Cl.[7] ..... B42D 1/00

[52] U.S. Cl. ..... 281/21.1; 281/29; 281/37; 412/36; 412/901; 428/41.8

[58] Field of Search ..... 281/21.1, 29, 37; 412/36, 901; 428/41.8

[56] References Cited

U.S. PATENT DOCUMENTS

| | | | |
|---|---|---|---|
| 2,510,263 | 6/1950 | Stein | 412/901 |
| 3,188,114 | 6/1965 | O'Brien et al. | 412/901 |
| 3,210,093 | 10/1965 | Steidinger | 281/21 |
| 3,437,506 | 4/1969 | Falberg | 412/36 |
| 3,825,963 | 7/1974 | Abildgaard et al. | 412/901 |
| 4,558,888 | 12/1985 | Hanson et al. | 412/901 |
| 4,762,341 | 8/1988 | Rabuse | 412/901 |
| 5,078,563 | 1/1992 | Lolli | 412/901 |
| 5,120,176 | 6/1992 | Bhatia et al. | 412/8 |
| 5,691,022 | 11/1997 | Knauf | 428/40.1 |
| 5,766,714 | 6/1998 | Profetto et al. | 428/40.1 |
| 5,800,890 | 9/1998 | Myers | 428/41.7 |
| 5,804,264 | 9/1998 | Bowen | 428/35.2 |

FOREIGN PATENT DOCUMENTS

| | | |
|---|---|---|
| 2 276 944 | 1/1976 | France . |
| 28 20 544 | 11/1979 | Germany . |

*Primary Examiner*—Andrea L. Pitts
*Assistant Examiner*—Monica Smith
*Attorney, Agent, or Firm*—Bacon & Thomas PLLC

[57] ABSTRACT

An improvement for a file binder of the type having a back portion (4) made of a porous or nearly porous material, for instance cardboard, wherein the back portion has an inner side on which an amount of glue (6) which melts under the influence of head is provided, includes a layer of substantially non-porous material (5) disposed between the back portion and the glue.

6 Claims, 1 Drawing Sheet

Fig.1
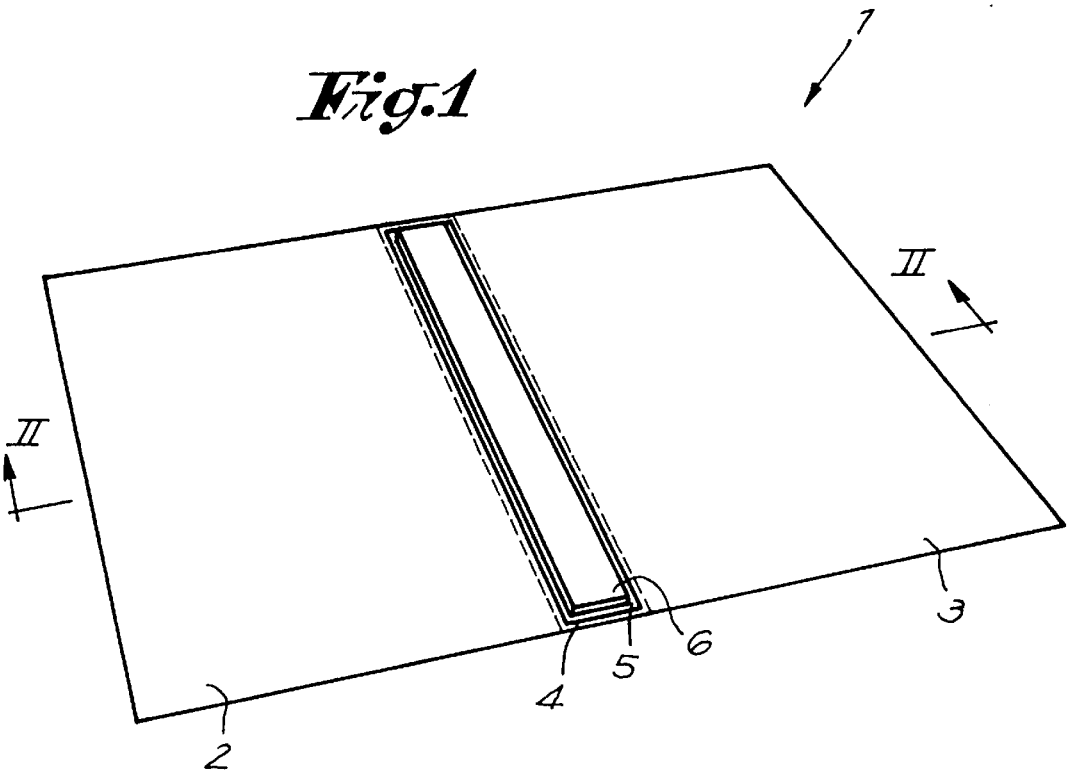
Fig.2
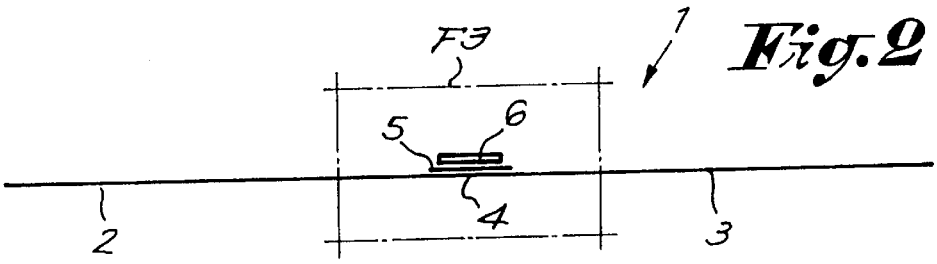
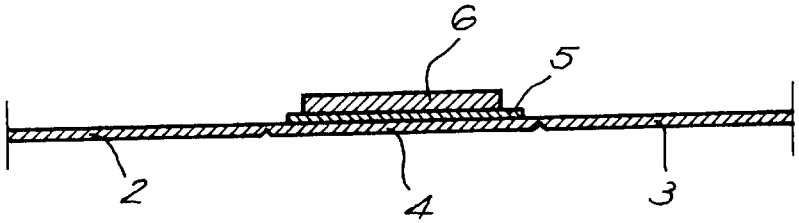
Fig.3

FILE BINDER

BACKGROUND OF THE INVENTION

1. Field of the Invention

The present invention relates to an improvement to binding files of the type which comprise a front sheet, a rear sheet and a back portion, wherein at least the back portion is made of a relatively porous material, for instance cardboard, and an amount of glue which melts under the influence of head is provided on an inner side of the back portion.

2. Description of the Related Art

In the present case, binding file is understood to mean both proper files and parts thereof, for instance parts which mainly consist of a back portion of the file with small projections to which a front sheet and/or a rear sheet may be attached.

In order to bind a bundle of sheets, documents or the like by such known binding files, these sheets or the like are placed between the front and the rear sheet of the file so that they are brought with one edge into contact with the above-mentioned amount of glue.

Subsequently, the whole is put vertically on a heating element with the back portion downward in such a manner that the glue melts and the sheets to be bound penetrate into the glue so that, after the binding file has been removed from the heating element and the glue has solidified, the sheets are firmly held in the binding file.

A serious disadvantage of binding files having the back portion made of a porous material, for instance cardboard, is the fact that when the glue melts, it is partly absorbed by the porous material. The glue penetrates into the pores of this material causing the amount of glue which remains available for the actual fastening of the sheets to be reduced.

SUMMARY OF THE INVENTION

The present invention aims at excluding this disadvantage and to avoid the need for a greater amount of glue to be applied to compensate for the amount of glue which penetrates into the material of which the back portion is made.

To this end, the invention comprises an improvement to binding files of the type having a back portion made of a porous or nearly porous material, for instance cardboard, with an inner side on which an amount of glue which melts under the influence of heat is provided, wherein the improvement comprises a substantially non-porous material disposed between the back portion and the glue.

BRIEF DESCRIPTION OF THE DRAWINGS

In order to better show the characteristics of the invention, the following preferred embodiments are described as examples only without being limitative in any way, with reference to the accompanying drawings, in which:

FIG. 1 represents a perspective view of a binding file according to the invention in an unfolded condition;

FIG. 2 represents a section according to line II—II in FIG. 1;

FIG. 3 represents a view to a larger scale of the part which is indicated in FIG. 2 with F3.

DETAILED DESCRIPTION OF THE PREFERRED EMBODIMENTS

The present invention concerns a binding file 1 which is made of a front sheet 2, a rear sheet 3 and a back portion 4, wherein at least back portion 4 is made of a porous or relatively porous material, for instance cardboard, and wherein back portion 4 is provided with a strip or layer 5 of synthetic material, for instance polyvinylchloride, to which a glue layer 6 is applied.

Layer 5 is provided at least at one side with an adhesive layer with which this strip is attached to back portion 4.

In such a way, a layer of material 5 which is substantially non-porous is provided between the porous material of which back portion 4 is made and glue layer 6 so that the glue cannot penetrate therein. Thereby, the whole thickness of glue remains available for binding the sheets or the like without having to apply a thicker layer of glue.

The present invention is by no means limited to the embodiments described above and represented in the drawings; but, such a binding file or a part of the binding file of which the back portion is made of a porous or relatively porous material may be made in various forms and dimensions while still remaining within the scope of the invention.

What is claimed is:

1. In a file binder including a back portion made of a relatively porous material with an inner side on which a layer of thermally meltable glue is provided, the improvement comprising:

a layer of substantially non-porous material disposed between said back portion and said glue layer.

2. The improvement in a file binder according to claim 1, further comprising:

an adhesive layer disposed on one side of said layer of substantially non-porous material by which said layer of substantially non-porous material is attached to said back portion.

3. The improvement in a file binder according to claim 1, wherein said layer of substantially non-porous material comprises a strip of synthetic material.

4. The improvement in a file binder according to claim 3, further comprising:

an adhesive layer disposed on one side of said strip of synthetic material by which said strip of synthetic material is attached to said back portion.

5. The improvement in a file binder according to claim 3, wherein said synthetic material comprises polyethylene.

6. The improvement in a file binder according to claim 5, further comprising:

an adhesive layer disposed on one side of said strip of polyethylene by which said strip of polyethylene is attached to said back portion.

* * * * *